US007028346B2

(12) United States Patent
Ermini

(10) Patent No.: US 7,028,346 B2
(45) Date of Patent: Apr. 18, 2006

(54) SELF-SANITIZING TOILET SEAT

(75) Inventor: Massimo Ermini, Florence (IT)

(73) Assignee: FAP S.r.l., Florence (IT)

( * ) Notice: Subject to any disclaimer, the term of this patent is extended or adjusted under 35 U.S.C. 154(b) by 114 days.

(21) Appl. No.: 10/486,994

(22) PCT Filed: Feb. 26, 2002

(86) PCT No.: PCT/IT02/00111

§ 371 (c)(1),
(2), (4) Date: Feb. 14, 2004

(87) PCT Pub. No.: WO03/015597

PCT Pub. Date: Feb. 27, 2003

(65) Prior Publication Data

US 2004/0172742 A1 Sep. 9, 2004

(30) Foreign Application Priority Data

Aug. 14, 2001 (IT) ..... FI01U0074

(51) Int. Cl.
*A47K 13/30* (2006.01)

(52) U.S. Cl. ..... 4/233; 4/DIG. 6

(58) Field of Classification Search ..... 4/233
See application file for complete search history.

(56) References Cited

U.S. PATENT DOCUMENTS

| | | | | |
|---|---|---|---|---|
| 1,215,197 A * | 2/1917 | Rosen | 4/233 |
| 5,940,895 A | 8/1999 | Wilson et al. | 4/237 |
| 5,963,991 A * | 10/1999 | Agosti et al. | 4/233 |
| 6,003,159 A | 12/1999 | Sadegh et al. | 4/233 |

FOREIGN PATENT DOCUMENTS

| | | |
|---|---|---|
| GB | 1537249 | 12/1978 |
| GB | 2275060 | 8/1994 |

* cited by examiner

*Primary Examiner*—Robert M. Fetsuga
(74) *Attorney, Agent, or Firm*—Pollack, P.C.; Grant E. Pollack

(57) ABSTRACT

A toilet seat having a generally ring-like shape, with an upper surface, that comes into contact with the user's skin, defined between an external perimeter edge and an internal perimeter edge, the seat comprising, or being associated with, a plurality of spray nozzles for spraying sanitizing fluid over the upper surface. The seat has a passage arranged in such a manner as to have a fluid inlet opening along the external perimeter edge and an outlet opening along the internal perimeter edge, the inlet opening being shaped so as to collect any excess fluid flowing beyond the external edge, such that the excess fluid drains through the passage, out the outlet opening and into the toilet bowl.

5 Claims, 3 Drawing Sheets

SELF-SANITIZING TOILET SEAT

FIELD OF THE INVENTION

The present invention relates generally to the field of sanitization and, more particularly, to toilets and the like.

BACKGROUND OF THE INVENTION

Conventional self-cleaning type toilet seats, e.g., those having a ring-like shape, are typically mounted at a fixed position on a toilet bowl and incorporate a selected number of spray nozzles. The nozzles are usually supported by a box-like structure on a rear portion of the seat. The nozzles typically moisten substantially the entire upper surface of the seat, i.e., the surface that contacts the user's skin. After fluid spraying has been completed, the same nozzles then provide a stream of air to dry the seat.

Nozzle operation is controlled by a suitable electronic control system that utilizes sensors to determine when a use of the toilet has been terminated and, consequently, trigger the seat cleaning process in preparation for the next use.

The sanitizing fluid, which is usually stored in a tank or like reservoir, is sprayed onto the seat abundance, causing at least a portion of the fluid to drip from the seat edges, both inside and outside the ring. While drippage from the internal perimeter of the seat edge is not considered a problem, since the sanitizing fluid flows into the toilet bowl, dripping from the outer perimeter edge results in the entire external surface of the bowl being covered with fluid. This is because the external surface is not usually reachable by the drying air stream. Apart from creating the unpleasant impression of a lack of cleanliness, the user's clothing is often stained when it brushes against the excess fluid on the external bowl surface, this being undoubtedly annoying.

It has been also proposed to form a radial passage within the seat, in order to convey the excess fluid directly from the outer perimeter of the seat into the toilet bowl, as shown for example in U.S. Pat. No. 6,003,159, GB2275060 and GB1357249.

OBJECTS AND SUMMARY OF THE INVENTION

Accordingly, it is an object of the present invention to provide a novel automatically sanitized toilet seat having a configuration that not only prevents the sanitizing fluid from dripping onto the external surface of the toilet bowl, but is also simpler, less bulky and has a more aesthetically pleasing shape.

BRIEF DESCRIPTION OF THE DRAWINGS

These and other objects and advantages of the automatically sanitized toilet seat, in accordance with the present inventions, will become apparent from the description set forth below of a specific, illustrative embodiment thereof, with reference to the following drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
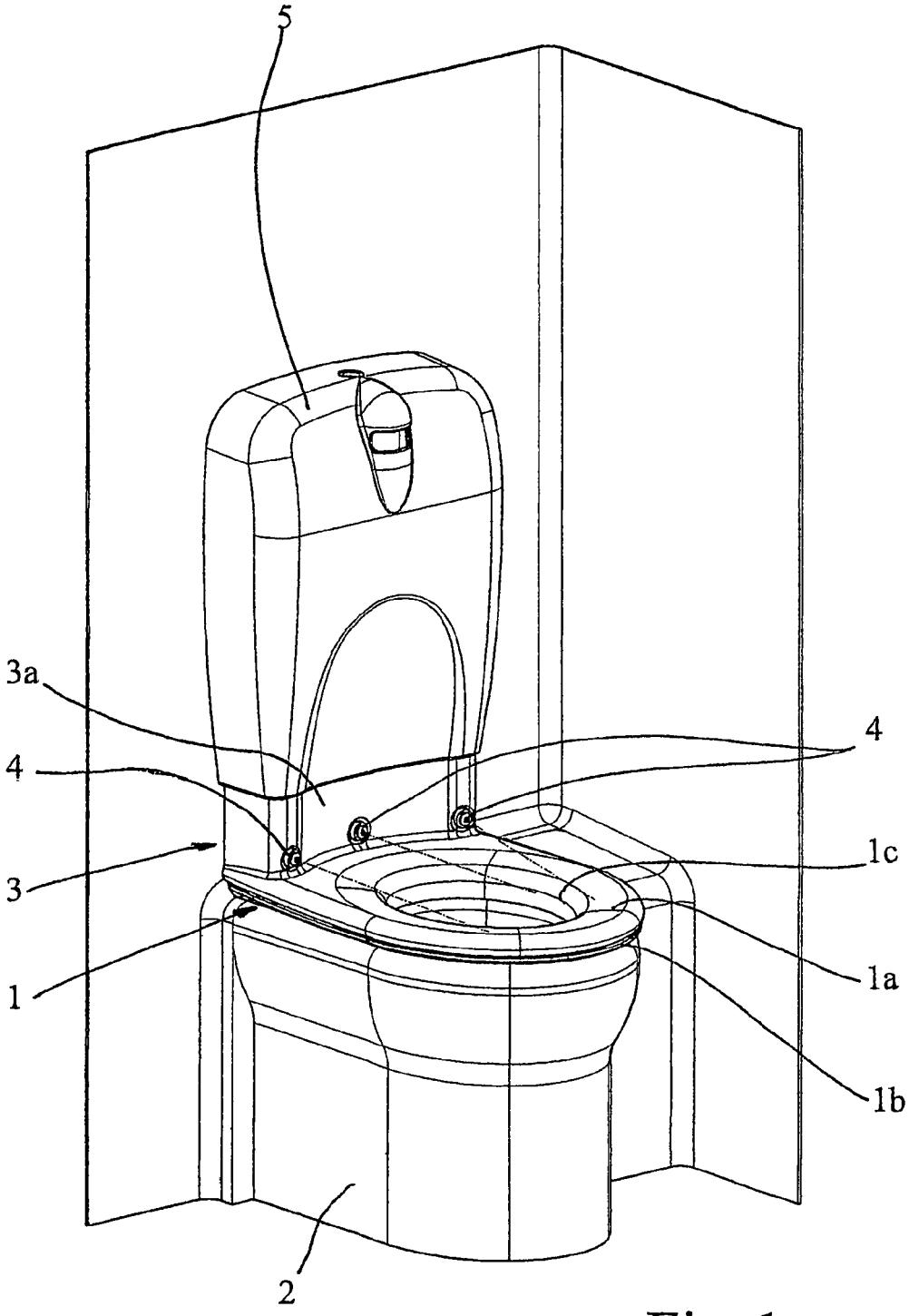
FIG. 1 is a perspective view of a toilet assembly having a self-sanitizing seat, according to one aspect of the present invention.

Referring now to the drawings and, more particularly, to FIGS. 1–5, there is shown generally a specific, illustrative self-sanitizing toilet seat 1, according to various aspects of the present invention. According to one embodiment, shown generally in FIG. 1, the seat has a conventional ring-shaped structure with an upper surface 1*a*, that will come into contact with a user's skin, defined between an external perimeter edge 1*b* and an internal perimeter edge 1*c*. The seat is arranged above a bowl 2 of confined water. Also like the conventional arrangements, from the rear part of seat 1, i.e., that portion where the backside of the user will come to be positioned, a box-like structure 3 is located of which a front wall 3*a* bears a plurality of nozzles 4, for example three (3), for flushing the upper surface 1*a* of the seat with a sanitizing fluid and, thereafter, providing a stream of air so as to dry the surface again.

The box-like structure desirably houses water and air circuits that feed the nozzles. A case 5 above the structure, and adjacent to a conventional tank containing toilet bowl-flushing water, houses an electronic system for controlling operation of the nozzles in response to a signal emitted by one or more selected sensor(s). Suitable sensors, as are well-known to those skilled in the art, are preferably capable of detecting the end of each individual use of the toilet and, consequently, activating a toilet sanitizing operation.

As illustrated in FIGS. 1–5, external edge 1*b* and internal edge 1*c* of seat 1 are in communication with one another via a passage 6 formed within the seat. More specifically, passage 6 is preferably defined by a two-part seat construction, the seat comprising a lower part 12 that rests on toilet bowl 2 and an upper part 11 that overlies the lower part. The upper part is desirably located over and above the box-like structure and includes upper surface 1*a* with external perimeter edge 1*b* and internal perimeter edge 1*c*.

Figure 2:
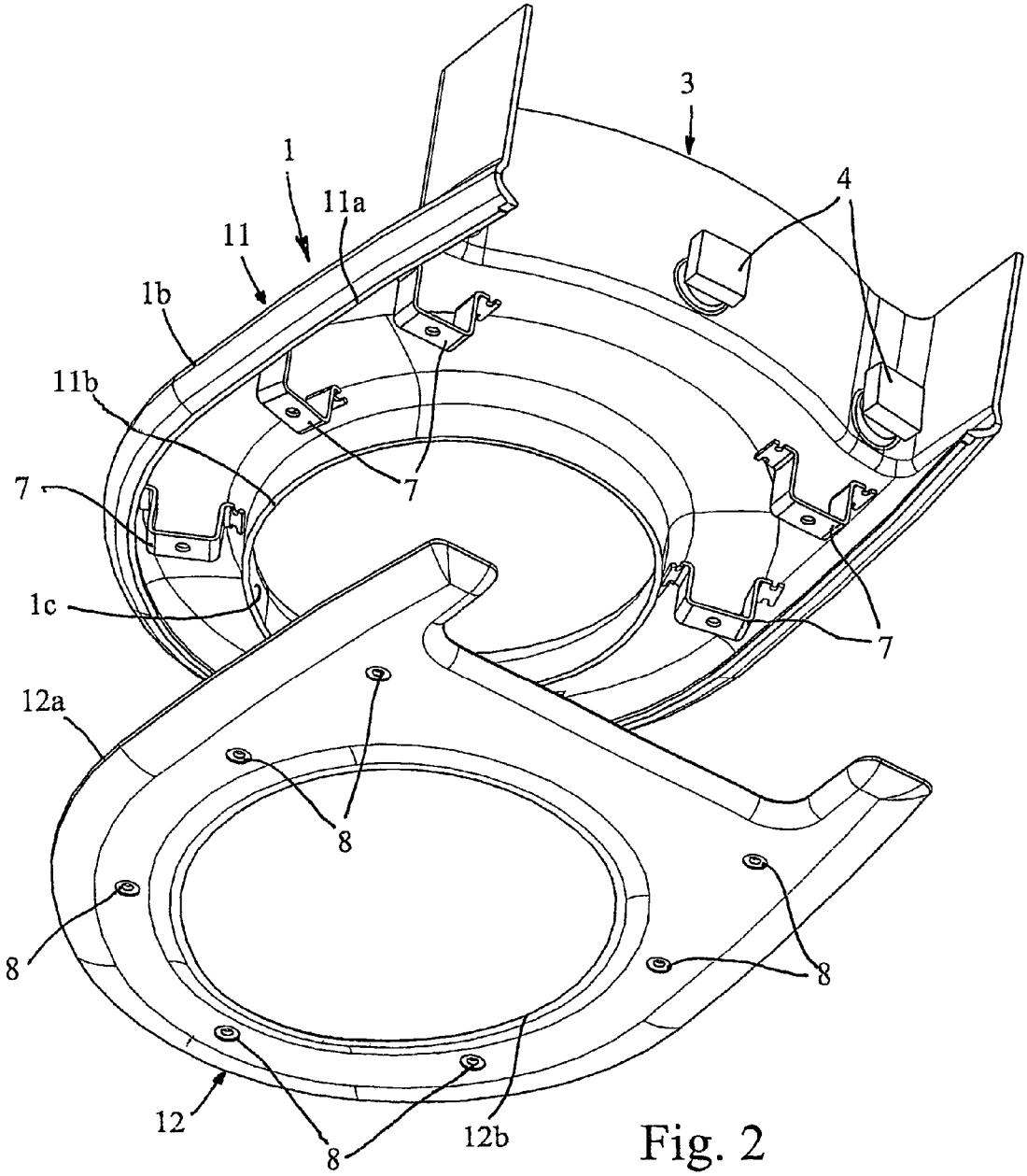
FIG. 2 is an exploded perspective view of a self-sanitizing toilet seat, according to one aspect of the present invention.

As best seen in FIG. 2, the two parts of the seat are preferably joined to one another and separated by U-shaped stirrups 7 extending downwardly from upper part 11 and arranged at substantially equal distances about the ring of the seat. The stirrups engage mounting screws (not shown) that pass through appropriate seatings 8 formed in lower part 12. By separating the upper and lower parts of the seat in this fashion, namely, using the stirrups, passage 6 is formed.

Figure 4:
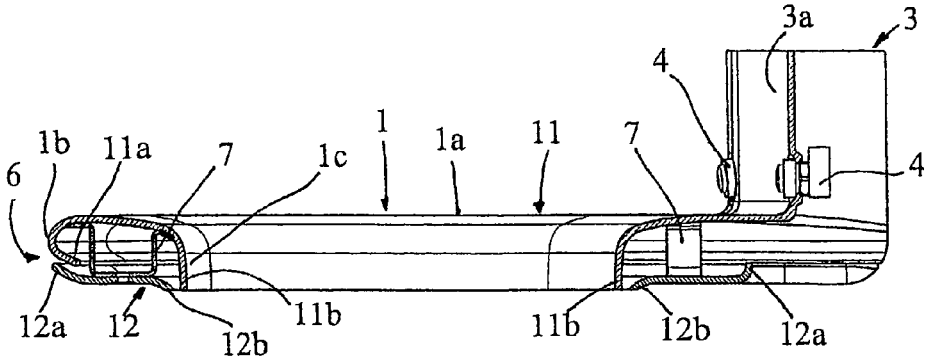
FIG. 4 is a sectional view taken along lines IV—IV of FIG. 3.
Figure 3:
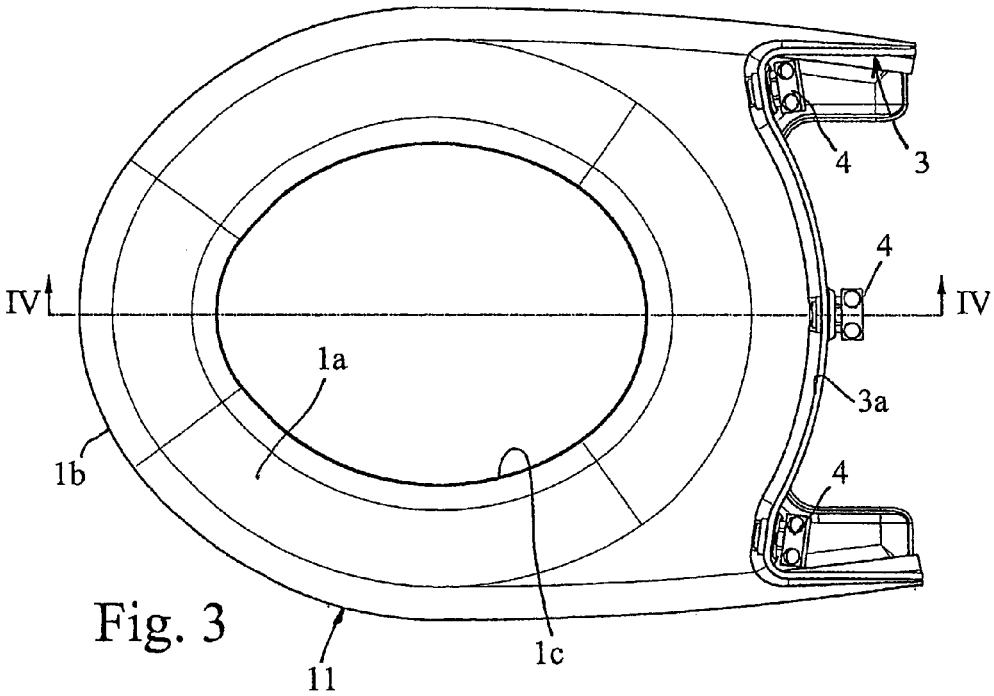
FIG. 3 is a plan view of the seat illustrated in FIG. 2.
Figure 5:
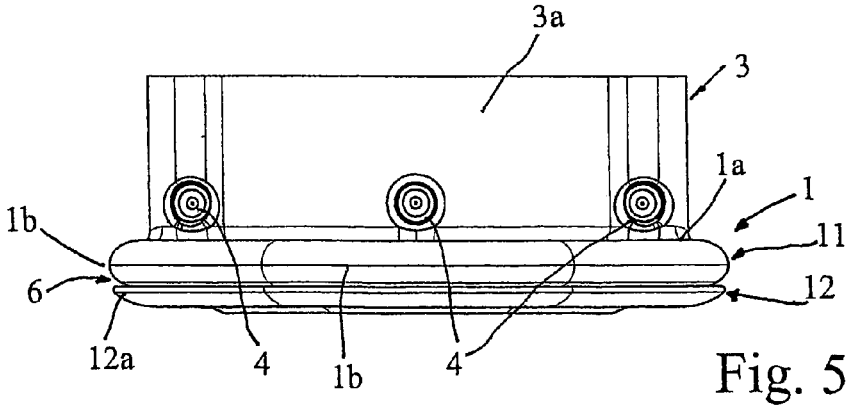
FIG. 5 is a front elevational view of the seat shown in FIG. 1.

Turning now to FIG. 4, a lip 12*a* is provided along the external perimeter of the lower part, the lip being bent obliquely upward such that the resulting shape of the part corresponds to that of a basin. Similarly, on the upper part there is provided an external perimeter lip 11*a* bent obliquely downward and toward the seat interior. In this manner, the lip projects into the basin defined by lower part 12, while the lower part remains a selected distance from lip 12*a*, thereby forming an inlet opening of passage 6.

Along its internal perimeter, on the other hand, lower part 12 is provided with a downwardly-pointing lip 12*b*. Upper part 11 is, in turn, provided with an internal perimeter lip 11*b* that extends vertically downward and, in conjunction with internal perimeter lip 12*b*, forms an outlet opening of passage 6, which faces the inside of toilet bowl 2.

Accordingly, after each use of the toilet, the nozzles spray sanitizing fluid onto the upper surface of seat 1, the excess fluid flowing over external edge 1*b* rather than dripping onto the outer surface of the toilet bowl. The excess fluid is collected within passage 6 and then drained away, into the inside of the bowl.

More specifically, as a result of surface adhesion, the fluid descends along external lip 11*a* and, thereby, passes through the inlet opening of hollow space 6. After dripping from the edge of the external lip, the fluid is collected by lip 12*a* and conveyed toward the internal perimeter of the seat, i.e., in the direction of the outlet opening of the passage. Upon passing through the opening, the fluid then falls into the toilet bowl. In order to facilitate the discharge of fluid, it has been found advantageous to slope the bottom of lower part 12 slightly downward as it passes from external lip 12*a* to internal lip 12*b*.

This arrangement has been found beneficial for assuring that not only the outer surface of bowl 2 remains dry, but also the surrounding floor, thereby creating an impression of order and cleanliness that is pleasant to the user, and avoiding any possibility of the user's clothes becoming wet and/or soiled. In this manner, the seat according to various aspects of the present invention, advantageously provides a highly efficient solution to a rather annoying problem, and does so using a structure of extraordinary simplicity.

Although the present invention has been shown and described using a passage that collects sanitizing fluid and conveys it from the external perimeter of the seat to the internal perimeter, those skilled in the art will appreciate that arrangements may be utilized other than the two-part one set forth above, within the spirit and scope of the present invention.

The two-part seat construction of the present invention has, in addition, been found advantageous for its simplicity, and its adaptability for use with a heater or, more particularly, integration of such heater with its upper part 11. For instance, a heater, in the form of electrical resistors (not shown), is provided for heating upper surface 1*a* of the seat to a temperature of about 30° C. This, in turn, causes any traces of humidity to evaporated that may have remained after passage of the air stream, the result being that users will be assured of a perfectly dry seat upon each use.

The embodiments illustrated above involve application of the present invention to restrooms typically utilized for railway carriages. However, its application to any toilet facility is understood, giving consideration to the purpose for which the present invention is intended. For instance, a self-sanitizing seat according to the present invention may be utilized generally in any public toilet facility in which problems may arise similar to those described above, within the spirit and scope of the present invention.

Various modifications and alterations to the invention may be appreciated based on a review of this disclosure. These changes and additions are intended to be within the scope and spirit of the invention as defined by the following claims.

What is claimed is:

1. A seat for a toilet bowl, the seat having a generally ring-shaped structure with an upper surface for coming into contact with a user, the surface being defined between an external perimeter edge and an internal perimeter edge, the seat comprising and being associated with a multiplicity of spray nozzles for moistening the upper surface with a sanitizing fluid, the seat comprising a passage formed so as to provide a fluid inlet opening along the external perimeter edge and a fluid outlet opening along the internal perimeter edge, the inlet opening being shaped in such a manner as to collect excess fluid flowing over the external edge, whereby the excess fluid is drained away and into the toilet bowl through the passage, the passage being defined by an upper part and a lower part connected to one another in a spaced manner, the lower part being provided with an external perimeter lip bent generally obliquely upward, wherein the upper part is provided with a corresponding external perimeter lip bent generally obliquely in a downward and inward direction, and spaced from the lip on the lower part so as to form the inlet opening of the passage, whereby the excess fluid that adheres to the surface of the external lip of the upper part enters the passage, dropping the external lip of the lower part.

2. The seat set forth in claim 1, wherein the outlet opening is formed by respective lips provided along the internal perimeter of the upper part and the lower part, the lips projecting downwardly toward the inside of the bowl.

3. The seat set forth in claim 1, wherein the bottom of the lower part slopes slightly downward as it passes from the external perimeter lip to the internal perimeter lip, thereby facilitating drainage of fluid toward the inside of the bowl.

4. The seat set forth in claim 1, wherein the lower part and the upper part are connected to one another in a spaced manner via a plurality of U-shaped stirrups arranged at substantially equal distances along the ring-like structure of the seat.

5. The seat set forth in claim 1, further comprising a heater for warming the upper surface so as to dry the same.

* * * * *